United States Patent [19]

Bain, Jr. et al.

[11] 4,097,775

[45] Jun. 27, 1978

[54] INFRARED SENSITIVE PHOTOCONDUCTIVE PICKUP TUBE

[75] Inventors: George W. Bain, Jr., Fort Wayne, Ind.; Stanley V. Forgue, Princeton; Albert G. Morris, Lawrenceville, both of N.J.

[73] Assignee: RCA Corporation, New York, N.Y.

[21] Appl. No.: 526,458

[22] Filed: Aug. 4, 1955

[51] Int. Cl.[2] ..... H01J 31/00; H01J 31/26

[52] U.S. Cl. ..... 313/388; 250/333; 427/76

[58] Field of Search ..... 313/94, 65, 65.1, 384, 313/385, 388, 94, 101; 252/501; 117/106, 201, 211, 34; 427/76; 315/10, 11; 250/330, 333; 358/110, 113

[56] References Cited

U.S. PATENT DOCUMENTS

| | | | |
|---|---|---|---|
| 2,659,682 | 11/1953 | Anderson | 427/74 |
| 2,688,564 | 9/1954 | Forgue | 427/74 |
| 2,710,813 | 6/1955 | Forgue | 427/78 |
| 2,730,638 | 1/1956 | Cashman | 313/385 |
| 2,739,084 | 3/1956 | Sommer | 148/31.5 |
| 2,742,550 | 4/1956 | Jenness | 338/11 |
| 2,809,315 | 10/1957 | Townsend et al. | 313/451 |
| 2,813,991 | 11/1957 | Taft et al. | 313/94 |
| 2,829,074 | 4/1958 | Lubszynski | 427/74 |
| 2,847,329 | 8/1958 | Schillberg et al. | 427/76 |

FOREIGN PATENT DOCUMENTS

| | | |
|---|---|---|
| 707,125 | 4/1954 | United Kingdom. |

OTHER PUBLICATIONS

Journal of Applied Physics, vol. 19, pp. 791–795, 1948.
Journal of Optical Society of America, vol. 38, pp. 582–588, 1948.
Journal of Optical Society of America, vol. 42, pp. 134–140, 152.
Research, vol. 6, No. 7, Jul. 1953, pp. 258–259.
Journal of Scientific Instruments, vol. 32, No. 4, Apr. 1955, pp. 142–143.

*Primary Examiner*—Maynard Wilbur
*Assistant Examiner*—T. M. Blum
*Attorney, Agent, or Firm*—E. M. Whitacre; G. H. Bruestle; R. M. Rodrick

EXEMPLARY CLAIM

1. A photoconductive target for a pickup tube comprising a layer of porous lead telluride on a transparent conductive layer, said porous lead telluride having a resistivity of approximately $10^{-11}$ ohm cm when maintained at a temperature substantially equal to liquid nitrogen temperature.

3 Claims, 4 Drawing Figures

Fig. 1.
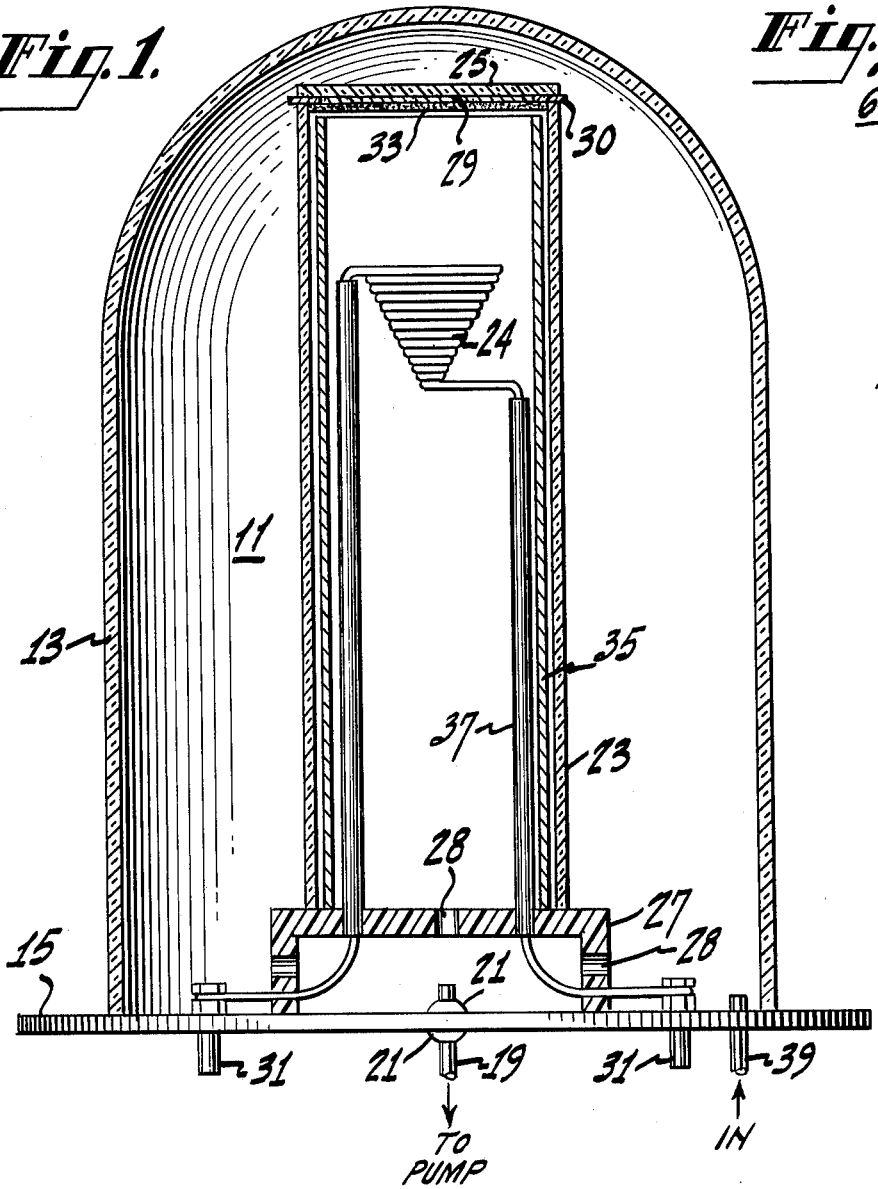
Fig. 3.
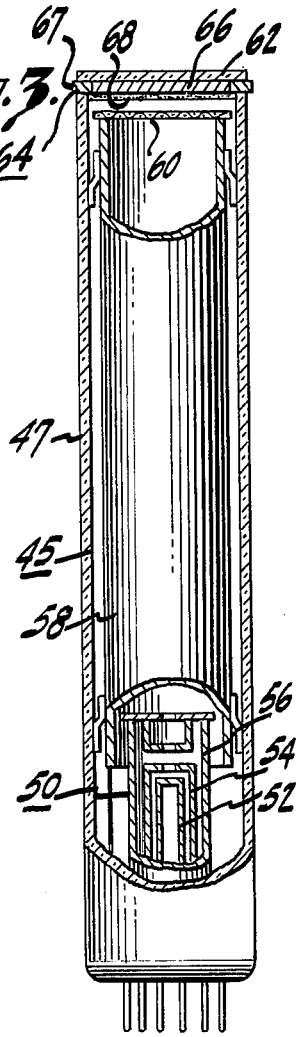
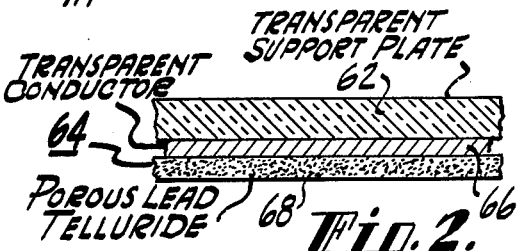
Fig. 2.
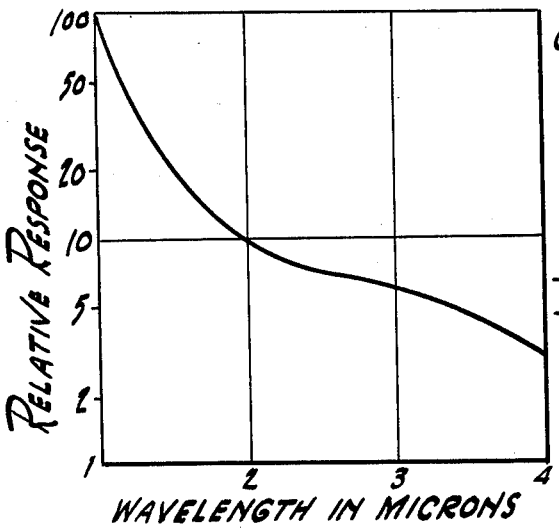
Fig. 4.

INFRARED SENSITIVE PHOTOCONDUCTIVE PICKUP TUBE

This invention relates to photoconductive target electrodes of the type having infrared response characteristics, for use in electron discharge devices, and to methods of making the same.

A photoconductive type pickup, or camera tube comprises an electron gun and a photoconductive target assembly contained within an evacuated envelope. The electron gun may be of any conventional type. The target assembly comprises a film of light-transparent electrically-conductive material on a transparent support plate, and a layer of photoconductive material deposited upon the electrically-conductive film. The target and the gun are so arranged within the envelope that the gun produces an electron beam which is caused to scan the photoconductive surface of the target.

The photoconductive material used for targets of the type briefly described above is an electrical insulator in the dark, but becomes electrically-conductive under the influence of radiations in the desired band of the spectrum. The conductivity increases with the amount of the radiations affecting the material, and is limited to the immediate area under the influence of the radiations.

Photoconductive type pickup tubes may be operated at either high or low electron beam velocity. That is, they may be operated with the target at sufficient voltage positive with respect to the cathode so that the electron beam will strike the target with enough force to drive more secondary electrons away from the photoconductive material than primary electrons landing on the material, thereby rendering it more positive. Or, they may have cathode and target at approximately the same potential so that the scanning electron beam deposits electrons on the target with a negligible amount of secondary emission, thereby rendering it more negative.

In both types of operation the electron beam establishes a reference, or equilibrium, potential on the photoconductive surface. In high velocity operation, this reference potential is substantially equal to the potential of a nearby collector electrode, while in low velocity operation this reference potential is substantially equal to the potential of the cathode of the electron gun.

When an infrared image is focused upon the target, the photo-conductive material becomes conductive in the areas where the radiation effects it. The effect of this conductivity is to cause a charge, with respect to the reference potential, to be established on the scanned surface of the photoconductor. The amount of the charge depends upon the intensity of the radiation incident upon each area while the polarity of the charge depends upon the type of operation. When the electron beam re-scans a charged area it discharges it and restores it to the reference potential. By means of capacitative coupling between the scanned surface and the transparent, electrically-conductive film, an electron current flows in the circuit of the latter. Variations in the electron current through this circuit, as more or fewer electrons are needed to restore the difference in potential, become the signal output of the tube. Alternately, the signal may be taken from the tube at an electron multiplier for the return beam located at the gun end of the tube. In this case, the operating polarity is reversed from that found in the former case. The output signal is multiplied by the gain of the multiplier when the latter is used.

Some of the qualities of photoconductive materials which affect their usefulness in pickup tubes for infrared use are infrared sensitivity, and resistivity in the dark.

Infrared sensitivity has reference to the ability of the material to become conductive under the influence of radiations of several microns. It is conventionally measured in micro-amperes of video current output per lumen of radiation on the target in the visible range, or in microampere of video current output per incident microwatt of radiation in the infrared range.

Resistivity in the dark has reference to that quality of the photoconductive material which enables it to store an electrical charge in a given spot without leakage from front to back surface as long as there is no radiation on the target. Dependent upon the resistivity of the target material is its dark current which is the current that flows through the material between energized electrodes when there is no radiation, on the target.

It is well known that photoconductive layers of lead telluride can be prepared to exhibit photoconductive sensitivity with infrared response to radiation of several microns wavelength. However, these layers have had a dark resistivity, prior to this invention, that is much too low for use in a storage type of pickup tube of the type described above. Although the resistivity of this material is increased at very low temperatures, in the order of that of liquid nitrogen, lead telluride still exhibits no sensitivity for pickup tube operation at these temperatures.

Accordingly, one object of the present invention is to provide an improved photoconductive, infrared sensitive target for electron discharge devices.

Another object is to provide an improved lead telluride target for such a pickup tube, and one characterized by a usuable resistivity in the dark.

Another object is to provide an improved infrared camera tube using lead telluride.

The above, and other related objects are accomplished in accordance with this invention by evaporating lead telluride upon a light-transparent, electrically-conductive surface in a purposely low vacuum. The low vacuum produces a porous layer of lead telluride which, with the conductive surface, form the target of an infrared pickup tube.

The invention is explained in more detail by reference to the accompanying single sheet of drawings wherein:

FIG. 1 is a sectional view, partly diagrammatic, of apparatus for preparing a photoconductive target in accordance with this invention;

FIG. 2 is an enlarged fragmentary sectional view of a lead telluride photoconductive target in accordance with this invention;

FIG. 3 is a sectional view of a photoconductive type pickup tube using a target prepared in accordance with this invention; and, FIG. 4 is a spectral characteristic of a target in accordance with this invention.

Referring to FIG. 1, there is shown a device for applying lead telluride photoconductive targets. The apparatus comprises principally an evacuation chamber 11 comprising a bell jar 13 mounted on a base plate 15 with an evacuating pump (not shown) communicating with the interior of the chamber 11 by means of a pipe 19 and a bushing 21. The junction of the bell jar 13 with the base plate 15, and the bushing 21, are both vacuum tight.

A glass blank, or tube envelope, 23 is placed with its face plate 25 in an upright position on a supporting member 27 which rests upon the base 15. Face plate 25 is joined to the tubular envelope portion 23 by means of a ring 30 sealed therebetween. There are several apertures 28 through support member 27 so that the entire bell jar 13 is at the same pressure. Inside the envelope 23 there is inserted a crucible 24 for holding the lead telluride, which is to be evaporated onto the face plate 25 which has been previously coated with a film 29 of transparent, electrically-conductive material such as tin chloride or tin oxide. The conductive film 29 is electrically connected to a ring 30 that is sealed between the envelope 23 and face plate 25.

The crucible 24 may be a formed tantalum boat, or may be formed by twisting tungsten filament wire into the cone-like shape shown and subsequently coating it with aluminum oxide. The wires which form the crucible 24 extend within the glass envelope 23, through openings in the supporting member 27, to vacuum tight terminals 31, where they make contact with a source of electrical current external to the chamber 11 and not shown in the drawing. Current from this source heats the crucible 24 and causes the lead telluride contained therein to be evaporated. The evaporated lead telluride condenses on the conductive coating 29 in the form of a layer 33. A shield 35 is inserted inside the glass envelope 23 to prevent the evaporated material from settling on the walls thereof. Sleeves 37 of insulating material are used to prevent the wires leading to the crucible 24 from short-circuiting against the metal shield 35 or the supporting member 27. The degree of vacuum in jar 11 may be controlled by the pump and an escape system, not shown, connected to an inlet tube 39.

Lead telluride has been used in photoconductive cells where relatively high dark current could be tolerated. Such cells were made by evaporating, from a heated crucible, lead telluride in a high vacuum of about $10-^{5}$ mm. or less of mercury. The lead telluride photoconductive films formed in this fashion do not have sufficient dark resistivity to operate as a time storage element, much less as a frame storage element, in a pickup tube as mentioned above. As an example, a lead telluride photoconductor made in the high vacuum of the prior art has a resistivity that is two or more orders of magnitude below that which is needed for frame storage operation, even when the photoconductor is cooled to liquid nitrogen temperature, and the resistivity is $10^{-6}$ ohm cm. or lower at room temperature.

It has been found in accordance with this invention that when the evaporation of lead telluride is done in a relatively low vacuum, the dark resistivity of a lead telluride film is greatly increased permitting the use of such a film as a target in an infrared pickup tube where the target is normally operated at temperatures close to that of liquid nitrogen. Resistivities of at least $10^{-11}$ ohm cm. have been measured across lead telluride films, made in accordance with this invention, when the films are held at approximately liquid nitrogen temperature.

Therefore, in accordance with this invention, the evacuation of bell jar 11 is limited to within the approximate range of 0.1 to 5 mm. of mercury. Any commercially available powder form of lead telluride, of an ultra pure form, may be placed in the crucible 24 which is heated to a brightness temperature of approximately 800° C. The amount of material evaporated is determined by the area of the target and is of any amount to form a film of approximately 5 microns thickness. Good targets have been made by depositing the material within a period of time of approximately 2 minutes.

After the lead telluride 33 has been deposited as described above, the target is baked in a vacuum within the approximate range of $10-^{5}$ to $10-^{6}$ mm. of mercury by any conventional baking means not shown. The vacuum bake is done at a temperature of approximately 140° C. and is continued until the sensitivity of the porous lead telluride is maximized. A typical example of the time for baking a porous lead telluride target in accordance with this invention is a period of time within the approximate range of 2 to 3 hours. If it is found that the maximum sensitivity point has been passed by the vacuum baking the sensitivity can be altered in the opposite direction by exposing the target at an elevated temperature, e.g. 100° C., to the atmosphere for short periods of time, e.g. one to ten minutes. It has been found that the sensitivity of a target in accordance with this invention is not affected by exposure to air for short periods of time when the target is not at an elevated temperature.

As an example of the above described vacuum baking steps, a typical porous lead telluride target, without baking, is sufficiently sensitive to detect heat radiated from an object at 140° C. to 150° C; after a vacuum bake of one hour it is sensitive to a body at 90° C; after a vacuum bake of another hour it is sensitive to a body at 55° C. to 60° C; and after a vacuum bake of still another hour it is sensitive to a body at 70° C. This latter sensitivity indicates that the maximum sensitivity point has been passed and the target should be exposed to air while it is at an elevated temperature for optimum sensitivity. By the process described above porous lead telluride targets have been made that are sensitive to heat radiated from a body at a temperature as low as 32° C. It should be understood that the above examples are given merely to illustrate the invention and they should not be construed so as to limit the invention.

Targets of the type described above may be used in a pickup tube of the type shown in FIG. 3. The pickup tube 45 comprises an evacuated envelope 47 having an electron gun 50 in one end, including the usual cathode 52, control electrode 54 and one or more accelerating electrodes 56. The final accelerating electrode 58 is a tubular member closed on the end removed from the gun 50 by a fine mesh screen 60 that is permeable to the electron beam developed by gun 50.

Supported on a face plate 62, forming the other end of envelope 47, is a target 64 which is shown in an enlarged fragmentary sectional view in FIG. 2. The target 64 comprises a transparent conductive coating, or signal plate, 66 on the face plate 62 and a porous layer of lead telluride 68, formed as described above. The signal plate 66 makes electrical contact with ring 67 that is sealed between the envelope 47 and the face plate 62. The pickup tube 45 may be operated with either high or low velocity operation as was described above.

As an example of one type of operation of the tube of FIG. 3, the signal plate 66 of the target 64 is operated at a potential that is substantially the same as that of cathode 52 so that the secondary electron emission from target 64 is less than the number of primary electrons that land on the target 64. Therefore, the porous lead telluride layer 68 is driven, while in the dark, in a negative direction to establish a reference potential substantially equal to the potential of cathode 52. During operation, the target 64 is cooled to liquid nitrogen temperature for optimum infrared response by any conventional cooling means, not shown. When an infrared image is directed onto the target 64, the porous lead telluride 68 becomes conductive in the areas where radiation affects it. The effect of this conductivity is to cause a charge, with respect to the reference potential, to be established on the porous lead telluride 68. When the electron beam from gun 50 re-scans a charged area of the porous lead telluride 68, the beam discharges it and restores it to its reference potential. By means of the capacity coupling between the scanned surface of the porous lead telluride 68 and the signal plate 66, electron current flows in the circuit of the signal plate 66 forming the output signals for the tube 45.

Physically, a lead telluride photoconductor, evaporated in a poor vacuum, may be said to have a "mat" surface. The term "mat" is used to represent a dull or smoky appearance which contrasts sharply with the smooth and shiny surface obtained when the same material is evaporated in a higher vacuum. This surface may also be described as "spongy" to distinguish it from the "hard" surface of the high vacuum targets.

Improvements of $10^5$ and higher in resistivity in the dark over the shiny type of lead telluride photoconductive targets have been observed in the mat surface targets. Also, the speed of response to sudden changes in radiation has been good with respect to a standard television frame time. These characteristics of the new photoconductive surface permit its use in infrared pickup tube applications as set forth above.

The mat surface is subject to smudging i.e. it may be wiped from its supporting surface, but it is sufficiently adherent so that no difficulty is encountered in its handling or use. Although targets including the mat photoconducter appear dull to the eye, they do not cause a grainy appearance in the transmitted picture.

The infrared sensitivity of the mat surface is such that targets in accordance with this invention are sufficiently sensitive to detect heat radiated from an object at 32° C.

FIG. 4 is a characteristic of the spectral sensitivity of a porous lead telluride target, with the target maintained at a temperature near that of liquid nitrogen, for a pickup tube in accordance with this invention. Monochromator measurements have indicated response to about four microns as shown by the spectral characteristic in FIG. 4. This range of sensitivity out to four microns extends into the infrared portion of the spectrum further than any previously known photoconductive materials used for pickup tube operation.

In the preferred pressure range of 0.1 to 5 mm. of mercury, the lead telluride layer is quite porous or mat in nature. The electrical properties of such a target are felt to be a function of this physical mat character of the layer. This is so, because mat targets made in low pressures of argon, oxygen, or air which may be admitted into the system 11 by means of inlet tube 39 are similar.

What is claimed is:

1. A photoconductive target for a pickup tube comprising a layer of porous lead telluride on a transparent conductive layer, said porous lead telluride having a resistivity of approximately $10^{-11}$ ohm cm when maintained at a temperature substantially equal to liquid nitrogen temperature.

2. A pickup tube for infrared radiations comprising, an evacuated envelope, an electron gun for providing an electron beam within said envelope, a target in the path of said beam, and said target including a porous layer of lead telluride on a transparent conductor, said porous lead telluride having a resistivity sufficiently high for frame storage operation.

3. A camera tube sensitive to infrared radiations comprising an elongated envelope, an electron gun in one end of said envelope for producing an electron beam, a target in the path of said beam, said target including a transparent conductive layer on a transparent support member, and a layer of porous lead telluride on said transparent conductive layer and toward said electron gun.

* * * * *

UNITED STATES PATENT OFFICE
CERTIFICATE OF CORRECTION

PATENT NO. : 4,097,775

DATED : June 27, 1978

INVENTOR(S) : George W. Bain, Jr. et al

It is certified that error appears in the above-identified patent and that said Letters Patent are hereby corrected as shown below:

Column 3, Line 41 "time" should be --line--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*